United States Patent [19]

Bauer

[11] 4,235,170

[45] Nov. 25, 1980

[54] RAILWAY CAR UNDERFRAME END SILL

[75] Inventor: Horace P. Bauer, Huntingdon Valley, Pa.

[73] Assignee: The Budd Company, Troy, Mich.

[21] Appl. No.: 955,983

[22] Filed: Oct. 30, 1978

[51] Int. Cl.[3] ..... B61D 1/00; B61D 17/04; B61D 49/00

[52] U.S. Cl. ..... 105/402; 105/410; 105/421; 213/220

[58] Field of Search ..... 105/396, 397, 402, 403, 105/421, 422, 423, 410; 213/220

[56] References Cited

U.S. PATENT DOCUMENTS

| | | | |
|---|---|---|---|
| 832,682 | 10/1906 | Lindström et al. | 105/402 |
| 2,294,357 | 8/1942 | Dean et al. | 105/396 X |
| 2,946,297 | 7/1960 | Dean et al. | 105/421 X |

*Primary Examiner*—Howard Beltran
*Attorney, Agent, or Firm*—A. L. Trueax, Jr.

[57] ABSTRACT

An end underframe structure having an open box structure forming a rigid unit capable of receiving high torsional or other forces developed in a railway car and includes primary and secondary end sills connected by side buffer members. Additional buffer members connect the secondary end sill to a bolster. Draft sill means extend from the center of the primary end sill to the center of the bolster member.

8 Claims, 11 Drawing Figures

FIG. 5
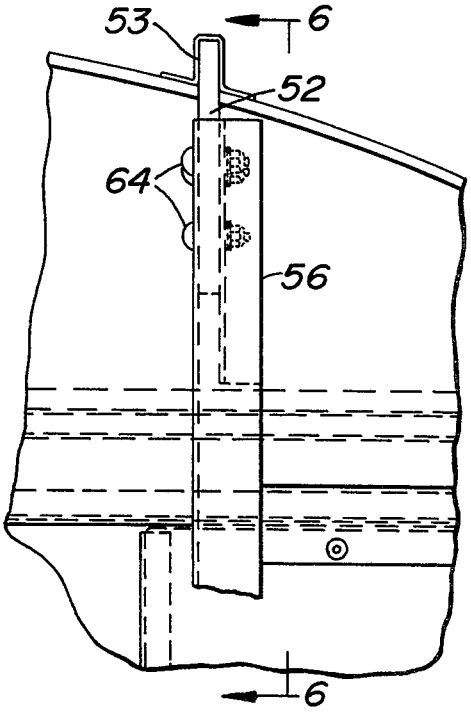
FIG. 4
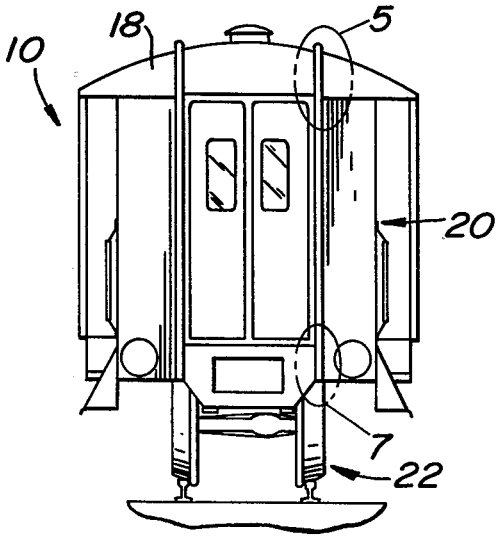
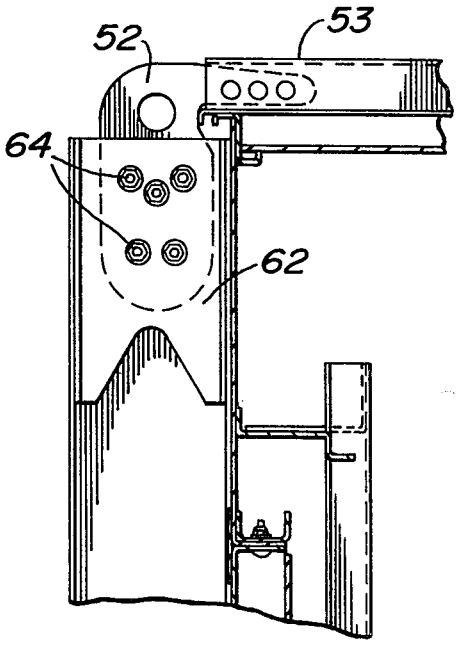
FIG. 6

RAILWAY CAR UNDERFRAME END SILL

When cost is one of the primary considerations in a railway car, many features not absolutely essential and which are found in many conventional cars are eliminated. For example, much of the equipment carried beneath the floor for heating, air conditioning, driving motors and the like are often not essential. In these cases, elaborate and relatively heavy center sills which extend from one end of the car to the other to provide high compressional strength and structure for elements to be attached thereto may be eliminated or modified.

In building a relatively inexpensive light weight car, vestibule partitions which permit strong structural beams to be disposed over doorways, for example, are not absolutely essential.

Also, in order to minimize the average cost of a car by planning for relatively large production, it is essential that the same parts used in the car accommodate a variety of different applications. For example, in railway cars made for foreign countries, different types of coupling arrangements between cars are involved. In a first type, side buffers or bumpers are placed in the corners on the front of the car to absorb bumps between the cars. In this type of coupler, a hook and eye arrangement is used to connect the car. A second type of coupler, generally found in the United States, involves a draft gear arrangement and a tight lock assembly which connects the adjacent cars and side buffers are not required.

Despite the priority given to costs considerations in building a light weight, relatively inexpensive car free of many accessories, it is important that the torsional and other angular forces applied to the ends of the car be received and transmitted to the bolster and side sills of the car.

The type of railway car to be generally illustrated is described in greater detail in a copending patent application of J. C. McQueston et al entitled "Methods and Means for Manufacturing a Railway Car," Ser. No. 935,769 filed Aug. 21, 1978. An underframe structure is described in detail in a U.S. Pat. No. 2,946,297 entitled "Underframe Structure for Railway Cars" to W. B. Dean et al.

It is an object of this invention to provide an improved end underframe structure for a railway car when no center sill is used.

It is a further object of this invention to provide an improved end underframe structure for a railway car with increased strength and rigidity for transmitting car body loads from the end to the side sills of the car.

It is a further object of this invention to provide an improved end underframe for a railway car of increased strength for transmitting car body loads from the buffer gear and hook assembly at the front of the car and which still provides structure capable of receiving torsional and other angular forces applied to the car body.

In accordance with the present invention, a rigid end underframe structure for receiving torsional and other forces in a railway car includes primary and secondary end sill extending transversely across the front of said car. The primary end sill is adapted to receive coupling elements including buffer gear on the front of the car. A first pair of recessed side buffer members connect the ends of the primary and secondary end sills to transmit forces therethrough especially those provided by forces on the buffer gear, when used. The recessed or set back members provide means for connecting steps leading to a door. A second pair connect the ends of secondary end sill to a bolster member. Centrally disposed draft sill members extend from the center of the primary end sill to the center of the bolster member.

Other objects and advantages of the present invention will be apparent and suggest themselves to those skilled in the art, from a reading of the following specification and claims, taken in conjunction with the accompanying drawings, in which:

FIG. 4 is a front view of a railway car illustrated in FIG. 1;

FIG. 5 is a front view of the elements included in a circle 5 of FIG. 4;

FIG. 6 is a view taken along lines 6—6 of FIG. 5;

Figure 1:
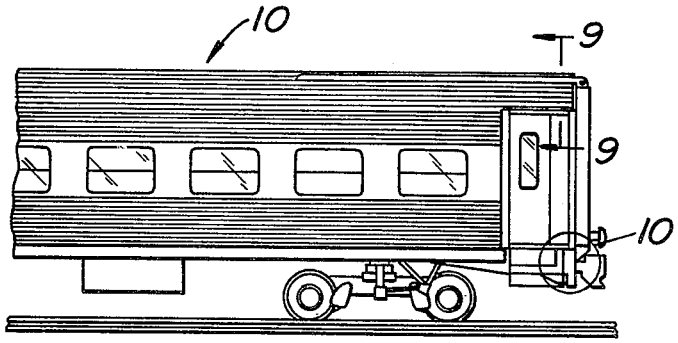
FIG. 1 is a side view, partly broken away, of a typical railway car into which an end underframe structure embodying the present invention may be incorporated.
Figure 2:
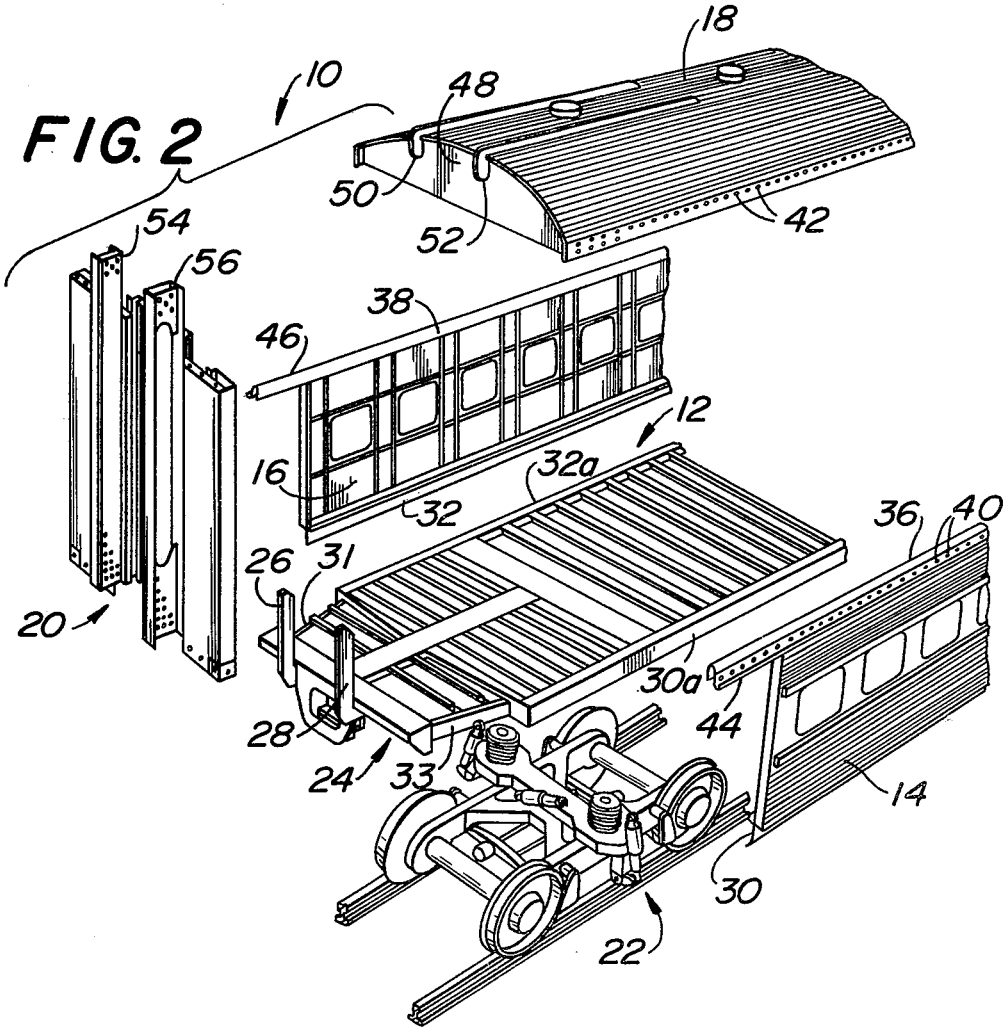
FIG. 2 is an exploded view, again broken away, illustrating some of the main elements in a typical railway car with which the underframe structure of the present invention may be used.

Referring particularly to FIGS. 1 and 2, a railway car 10 comprises a plurality of components including a floor frame assembly 12 including transversely parallel support beams, a pair of sidewalls 14 and 16, a roof 18, and a pair of end frame assemblies of which only the assembly 20 is illustrated. These are the basic components forming the car body which is connected to a pair of trucks, such as truck 22. It is understood that the opposite end of the car illustrated include parts similar to the end to be described.

Figure 3:
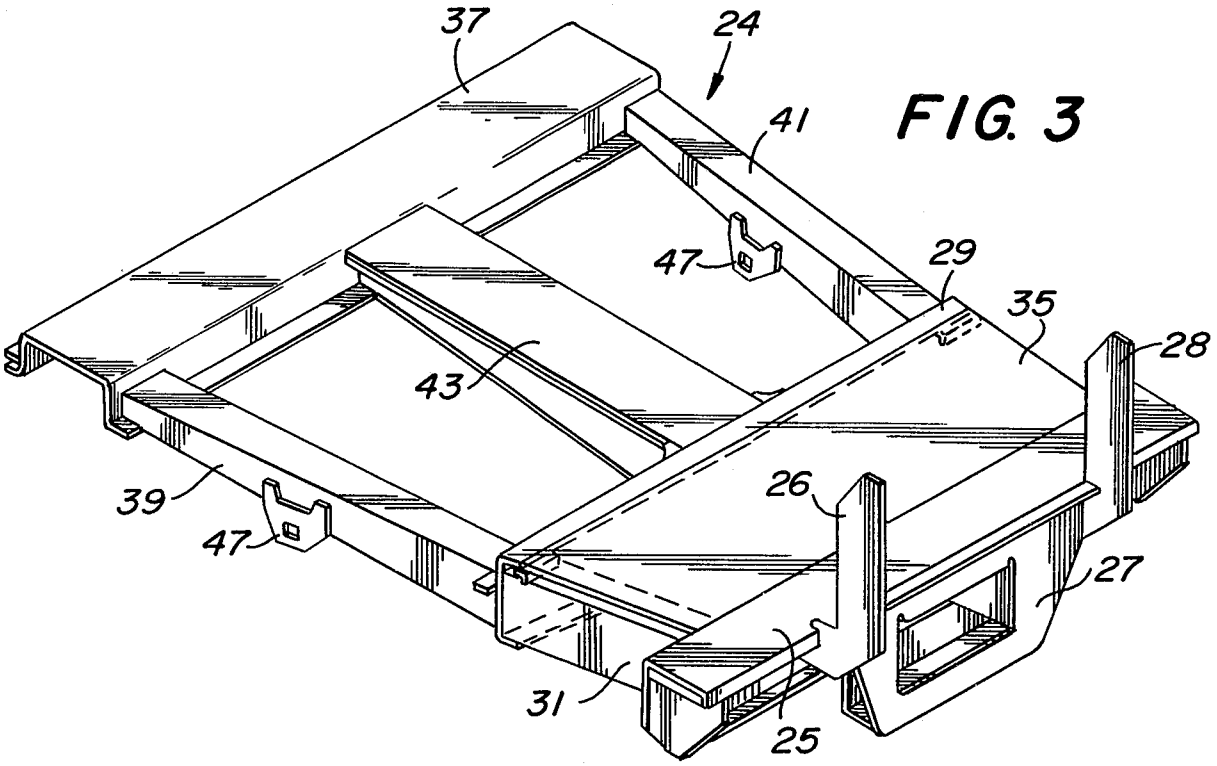
FIG. 3 is an isometric view of an end underframe built in accordance with the present invention.

An end underframe 24, forming part of the floor supports, illustrated in detail in FIG. 3, comprises one of the main features of the present invention. The end underframe includes a pair of lugs 26 and 28 connected thereto.

The sideframes 14 and 16 include side sills 30 and 32 adapted to be connected to the side beams of the floor 302 and 322, which may also be considered as parts of the side sills after connections.

The sideframes 14 and 16 include longitudinally extending top rails 36 and 38, respectively. The top rails 36 and 38 may include apertures 40 adapted to receive bolts which also pass into openings 42 in the top rails of the roof 18. Portions 44 and 46 of the top rails 36 and 38, respectively, extend beyond the sideframes 14 and 16 on both ends to accommodate end door openings for the car.

A roof 18 includes conventional roof rails on both sides. A bulk head sheet 48 is provided at both ends of the rail. Purlines are provided at both ends of the roof and include a pair of lugs 50 and 52. The lugs 50 and 52 provide means for connecting the roof to the collision posts 54 and 56, respectively, which are included in the end frame assembly. Many parts not described in detail are conventional. Only those parts which are related to the end underframe construction or to its description are illustrated, it being understood that such parts are merely examples.

Referring particularly to FIG. 3, an end underframe 24 is provided at the ends of the car. This end underframe is relatively rigid and is designed to accomodate the various forces which are applied to the ends of the car. For example, during normal operation, collisions or accidents, various torsional forces are developed in the shell of the car. Also, other angular forces including shear forces are applied to the ends of the frame. The relatively rigid construction of the underframe 24 and the various ways in which the tubular members are disposed with respect to each other provide means for carrying the forces back from the end of the car into the steel body. These forces are transmitted from the end of the car to the end underframe 24 and to the side sills and other elements associated with the shell of the car.

The particular type of car toward which the invention is related involves a relatively flat roof car in which no vestibule partitions are used and there are door openings at both ends of the car. Because there are no relatively high arches over the doorways and because of the lack of vestibule partitions, the structure toward the roof area does not include members to transmit much of the forces developed at the end of the car. It is therefore necessary to provide the box-type arrangement illustrated to steer and distribute the various forces.

The end underframe structure 24 comprises a primary front end sill 25 having the lugs 26 and 28 mounted thereto. The primary end sill 25 comprises a strong structural inverted L-shaped member having a bottom flange.

A coupler and draft gear carrier member 27 is suitably mounted to the end sill 25 by conventional means. The draft gear carrier or coupler 27 may be connected to elements set back and illustrated which may include various hooks and eye arrangements to provide connecting means between adjacent cars. These elements are secured back of the primary end sill 25 in alignment with a draft sill 43. Another type of connector would include the tight lock arrangement found in most cars in the United States. These types of different connections are well known and therefore not described in detail.

While not illustrated in detail, the primary end sill 25 is disposed to receive buffer elements on the corners of the front ends thereof. These buffer elements are common in European cars and are designed when a hook and eye coupling arrangement is employed and there is physical contact involving high forces between adjacent cars. These buffers are not illustrated and are designed to absorb the energy when one car hits or bumps into the car in front of it. While the buffer arrangement is not illustrated, the end of the frame structure 25 is designed to accommodate the car body when such buffers are used. Consequently, the primary end sill 25 is designed to receive one of two different types of couplers thereon. This facilitates the manufacturing of the car and does not necessitate different arrangements or designs for cars going to different countries and involving different coupling arrangements.

A secondary end sill 29 comprising a C-shaped member is disposed in spaced relationship with respect to the primary end sill 25. Large tubular members or beams 31 and 33 connect the ends of the primary end sill 25 to the ends of the secondary end sills 29. A solid plate or girder web 35 is disposed on top of the tubular members 31 and 33 to provide additional strength by forming an open box structure consisting of girder web 35, tubular members 31, 33 and end sills 25,29. The tubular members 31 and 33 are somewhat recessed to permit a stairway to be connected under the doorway.

In addition to recessing the members 31 and 33 for stairway considerations, the members are angularly disposed extending from the end of the end sill 29 to areas set back from the ends of the end sill 25. The members 31 and 33 are also angularly disposed with respect to side buffer members 39 and 41. This is done to accommodate wheel clearances, as for example when the car is turning and the angular positions of the wheels on the trucks with respect to the car body and buffer members 39 and 41 change. Thus the angular positions of the members 31 and 33 provide two functions.

While not illustrated, the bumper or buffer arrangement which may be connected to the primary end sill 25 is connected in a manner so that the forces exerted thereon are transmitted from the primary end sill 25 to the tubular members 31 and 33. The forces are distributed and continue on with some of the forces being distributed to the secondary end sill 29.

A bolster 37 is disposed to ride on air or coil springs which are connected to the truck. This is not illustrated in detail, but is conventional. A second pair of side buffer assemblies comprising rigid tubular members 39 and 41 connect the secondary end sill 29 to the bolster 37. Forces developed at the front of the car which reach the secondary sill 29 are further transmitted and distributed by means of the side buffer tubular members 39 and 41. The various forces continue and are transmitted into the bolster 37, and into the shell of the car including the side sills. Most of the forces, however, are directed into the floor which transmits the forces into the side sill, as illustrated in FIG. 2.

A draft sill means comprises a channel member 43, extending from the bolster 37 to the coupler arrangement 27. The central disposition of the draft sill 43 transmits the forces applied to the coupling means extending through the coupler carrier 27 back through the end sills 25 and 29 and to the bolster 37. Again, most of the forces are transmitted through the structure of the floor of the car. Consequently, it may be seen that the relatively rigid tubular members involved in the structure illustrated in FIG. 3 provide means for handling the high torsional forces which tend to twist the car shell. At the same time, various other forces are transmitted and distributed throughout the car body by means of the end underframe structure 24.

The end frame structure 25 is designed to accommodate different types of coupling arrangements involving different forces. The side buffer elements are made sufficiently strong to accomodate any forces which are exerted against any buffer elements when used. The draft sill element 43 provides strength for absorbing and transmitting any forces developed at the point of coupling at the coupler arrangement 27.

The relatively rigid and strong construction of the end underframe 24 makes it possible to build a relatively flat roof car which does not have any force transmitting elements connected between the door openings. Likewise, the recessed elements of the tubular elements 31 and 33 make it possible to provide the steps for the door opening without detracting from the means for transmitting the end forces to the car shell.

The various FIGS. 5–11 are illustrated merely to show some general ways in which the car body may be assembled. In some cases, the assembly is illustrated as being by means of bolts. It is apparent, however, that the connections may be welded. The car body itself is merely illustrative and of the type described in detail in the aforementioned copending patent application. The features illustrated in these figures, while shown to show the general environment of the invention, is not directed particularly to the invention, which involves the end underframe structure of the type illustrated in FIG. 3.

Referring particularly to FIGS. 5 and 6, the collision lugs 50 and 52, secured to purlines in the roof of the car, with only one lug 52 and purline 53 being illustrated in FIGS. 5 and 6, are inserted into the collision posts as the post 56. A top tie member 62 is secured to the interior of the collision post for additional strength. The lug 52 is held securely to the collision post 56 by means for bolts 64 held in place by suitable nuts.

Figure 7:
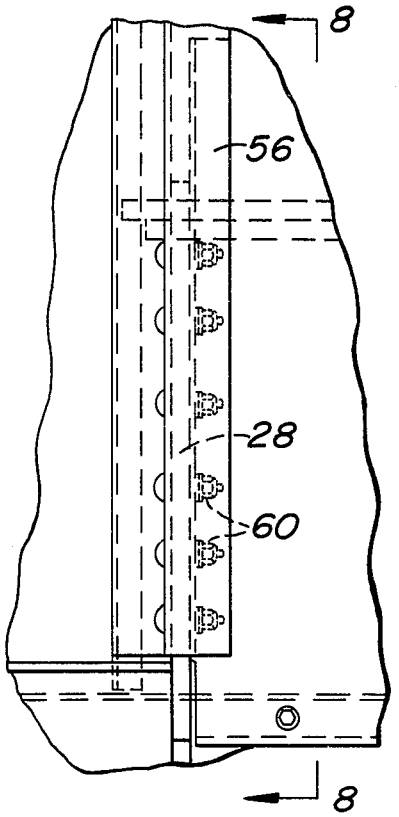
FIG. 7 is a front view of the elements illustrated in the circle 7 of FIG. 4.
Figure 8:
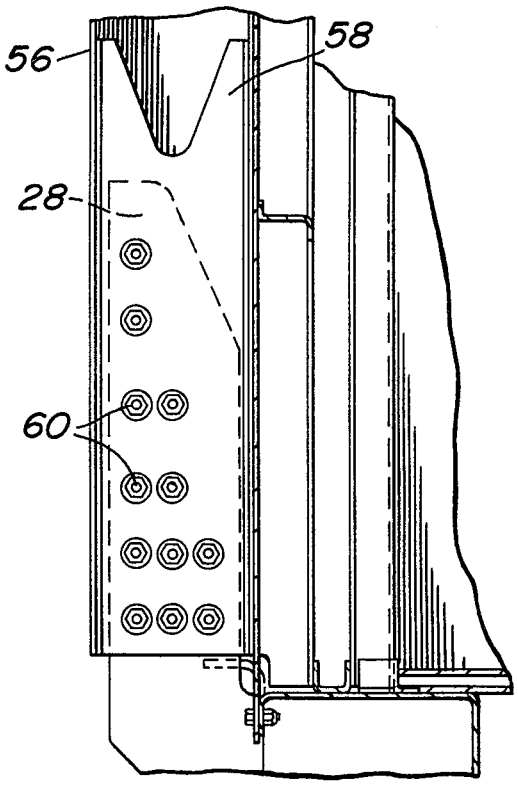
FIG. 8 is a cross-sectional view taken along lines 8—8 of FIG. 7.

Referring particularly to FIGS. 7 and 8, the tie lugs 26 and 28 on the end underframe 24 are connected to collision posts 54 and 56 of which only one post 56 and one lug 28 is illustrated in FIG. 8. A tie member 58 is secured by welding or otherwise to the interior of the collision post 56 for additional strength. After the collision post 56 is secured over the lug 28, they may be secured in place by a plurality of bolts which are held in place by suitable nuts, not illustrated. Again welding may be employed.

After the side walls 14 and 16 with the end frames 20 and 22 have been erected and secured together, the roof 18 is raised and put in place.

Figure 9:
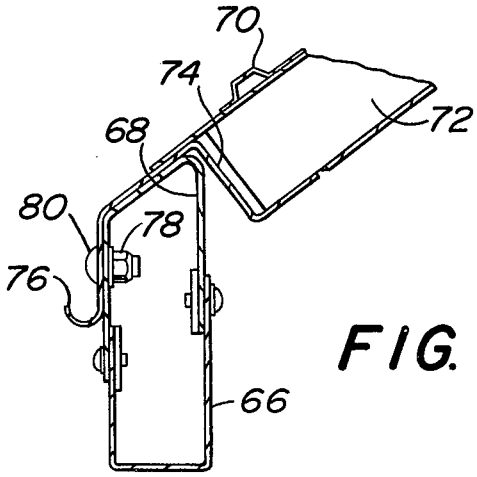
FIG. 9 is a cross-sectional view taken along lines 9—9 of FIG. 1.

Referring to FIG. 9, vertical posts of the side frames, of which only one post 66 is illustrated, are disposed to receive the top side rail 68. The roof 18 comprises top roof corrugations 70, arcuately extending carlines 72, and roof rail 74. A drain element 76 is provided as part of the roof structure. A nut 78 and bolt 80 assembly passes through the post 66 and the top rail 68.

Figure 10:
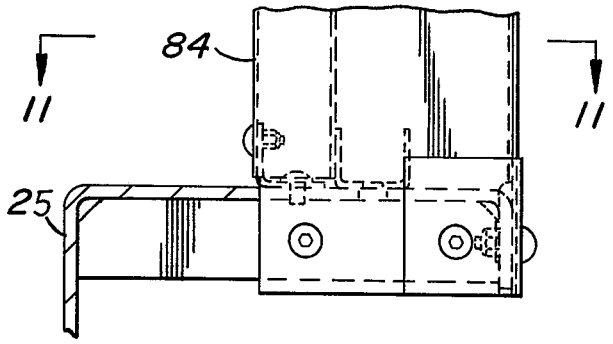
FIG. 10 is a side view of the elements included in the circle 10 of FIG. 1.
Figure 11:
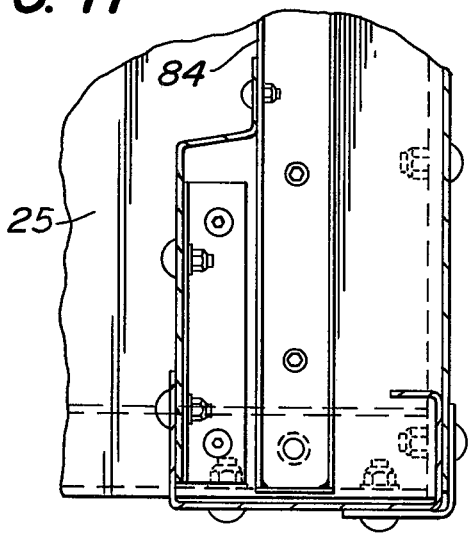
FIG. 11 is a cross-sectional view taken along lines 11—11 of FIG. 10.

Referring to FIGS. 10 and 11, the top of the end sill 25 includes a corner post 84 suitably mounted thereto by bolting or welding. Various reinforcement means providing channel elements as illustrated in FIG. 1 are provided. All of the details of this construction are somewhat conventional and therefore not shown or described in detail.

What is claimed is:

1. An end underframe structure for a railway car comprising:

(a) a primary end sill extending transversely across the front of said car, (b) a secondary end sill spaced and parallel to said primary end sill, (c) a bolster member, (d) a first pair of side buffer members connecting said primary and secondary end sills, (e) a girder web positioned over said sills and said first pair of buffer members and being connected thereto for forming an open box structure having increased strength, (f) a second pair of side buffer members connecting said secondary end sill to said bolster member, and (g) a draft sill member centrally disposed between said first and second pairs of said side buffer members and extending longitudinally with respect to said car from the center of said primary end sill to the center of said bolster member.

2. An end underframe structure as set forth in claim 1 wherein said first pair of side buffer members are connected longitudinally of said car substantially from the ends of said primary end sill substantially to the ends of said secondary end sill.

3. An end underframe structure as set forth in claim 2 wherein said second pair of side buffer members are connected longitudinally of said car from ends of said secondary sill to said bolster.

4. An end underframe structure as set forth in claim 3 wherein said first pair of side buffer members are disposed below door openings at the side ends of said car.

5. An end underframe structure as set forth in claim 4 wherein said first pair of side buffer members are recessed at an angle between said primary and secondary end sills to permit stairway attachments thereto and to provide wheel clearance.

6. An end underframe structure as set forth in claim 5 wherein said first and second side buffer members comprise relatively large tubular members.

7. An end underframe structure as set forth in claim 6 wherein a coupler carrier arrangement is disposed on said primary end sill in alignment with said draft sill to permit coupling elements to be set back into said coupler carrier so that forces exerted on said coupling element are transmitted to said draft sill.

8. An end underframe structure as set forth in claim 7 wherein said first and second side buffer members are longitudinally disposed with respect to said car in alignment with buffer elements adapted to be fitted to the bottom end of said car.

* * * * *